US009257742B2

(12) United States Patent
Auckland et al.

(10) Patent No.: US 9,257,742 B2
(45) Date of Patent: Feb. 9, 2016

(54) MANDREL-WOUND MAGNETIC ANTENNA AND METHOD OF MAKING SAME

(71) Applicants: David Auckland, College Park, MD (US); Chris Daniel, Westminster, MD (US)

(72) Inventors: David Auckland, College Park, MD (US); Chris Daniel, Westminster, MD (US)

( * ) Notice: Subject to any disclaimer, the term of this patent is extended or adjusted under 35 U.S.C. 154(b) by 101 days.

(21) Appl. No.: 14/184,980

(22) Filed: Feb. 20, 2014

(65) Prior Publication Data

US 2015/0236405 A1 Aug. 20, 2015

(51) Int. Cl.
*H01Q 1/36* (2006.01)

(52) U.S. Cl.
CPC ..... *H01Q 1/364* (2013.01)

(58) Field of Classification Search
CPC ..... H01Q 1/2225; H01Q 7/00; H01Q 1/38; H01Q 1/364
USPC ..... 343/787, 866, 867, 742; 235/492; 29/600, 850
See application file for complete search history.

(56) References Cited

U.S. PATENT DOCUMENTS

| | | | | |
|---|---|---|---|---|
| 6,728,284 | B1 * | 4/2004 | Birx et al. | 372/82 |
| 8,558,752 | B2 * | 10/2013 | Amadeo et al. | 343/867 |
| 2011/0204147 | A1 * | 8/2011 | Amadeo et al. | 235/492 |
| 2011/0205140 | A1 * | 8/2011 | Amadeo et al. | 343/866 |

* cited by examiner

*Primary Examiner* — Lam T Mai

(57) ABSTRACT

An antenna includes an electrical excitation component and a core component. The electrical excitation component has and input, an output and a conducting component. The conducting component is disposed between the input and the output and can conduct current from the input to the output. The core component has a concentrically wound magnetic film having a substrate and a magnetic material layer. The core component can have a magnetic current loop induced therein. The electrical excitation component is arranged such that concentric magnetic fields associated with current conducted through the electrical excitation component are additionally associated with a magnetic current loop within the core component.

20 Claims, 19 Drawing Sheets

MANDREL-WOUND MAGNETIC ANTENNA AND METHOD OF MAKING SAME

BACKGROUND

The present invention generally relates to antennas.

There has been a theoretical limit on the gain-bandwidth product that is achievable by an antenna. This limit applies whether the antenna is electric (i.e., charge-coupled) or magnetic (i.e., flux-coupled) in nature. Usually, increasing bandwidth (or decreasing Q) leads to a decrease in gain over the bandwidth of interest. There continue to be new results reporting ever closer encroachments on this limit.

Two types of conventional antennas will now be described with reference to FIGS. 1-8.

FIG. 1 illustrates an electrical dipole 108 and the electric and magnetic fields associated therewith.

As shown in the figure, a z-axis 102, an x-axis 106 and a y-axis 104 create a right-hand coordinate system. For purposes of discussion, in this example, electrical dipole 108 is disposed along z-axis 102. Electrical dipole 108 has an electrical field, represented by sample lines 110, resulting from the disposition of positive charge +Q in the positive portion of z-axis 102 and negative charge −Q in the negative portion of z-axis 102. In accordance with the "right hand rule," electrical dipole 108 has a concentric magnetic field, represented by sample line 112.

For purposes of discussion, consider the x-y plane where line 112 intersects lines 110. In this plane, constant magnetic field strengths form continuous circles and follow a right hand vector orientation rule. The electric fields for electric dipole 108 are spatially orthogonal to the magnetic fields and their lines of force begin and end on the ends of the electric monopole (charge coupled). The electric fields and magnetic fields may be represented as vectors pairs, samples of which are shown as electric field vector 114 and magnetic field vector 116, and electric field vector 118 and magnetic field vector 120. The vector cross product of an electric field vector and magnetic field vector describe power flow that is radially outward from electric dipole 108.

In many applications, an electric dipole may be used as an antenna, wherein the length of the electric dipole antenna may be equal to one half of the wavelength of the first harmonic of an electromagnetic wave that may be transmitted/received. In regards to Earth-bound antenna applications, e.g., a conventional radio station antenna, an electric dipole may be cut in half, to form an electric monopole, wherein the Earth approximates an infinite ground plane and ideal ground. An electric monopole antenna would provide field characteristics similar to an electric dipole associated with FIG. 1. In particular, if the electric monopole were to correspond to the axis of the antenna, the power radiating from the antenna would radiate outward such that the length of the electric monopole antenna may equal one fourth of the wavelength of the first harmonic of an electromagnetic wave that may be transmitted/received. The field characteristics associated with an electric dipole (and the electric monopole) should be compared to a magnetic dipole, as described with reference to FIG. 2.

FIG. 2 illustrates a magnetic dipole 208 and the electric and magnetic fields associated therewith.

As shown in the figure, a z-axis 202, an x-axis 206 and a y-axis 204 create a right-hand coordinate system. For purposes of discussion, in this example, magnetic dipole 208 is disposed along z-axis 202. Magnetic dipole 208 generates lines of electric field, represented by sample line 212, that encircle it in the x-y plane. Magnetic dipole 208 generates lines of magnetic field, represented by sample lines 210, that begin and end on surfaces having a net magnetic flux density. Again, the electric fields and magnetic fields may be represented as vectors pairs, samples of which are shown as electric field vector 214 and magnetic field vector 216, and electric field vector 218 and magnetic field vector 220.

The vector cross product of an electric field vector and magnetic field vector describe power flow that is radially outward from magnetic dipole 208. It should be noted that if the magnitude of M equals the magnitude of $\eta_0 J$, then $E(M_D) = -H(J)$ and $H(M_D) = E(J)$, where J is the electric current density in $A/m^2$, M is the magnetic current density in $V/m^2$, E is the electric field intensity in V/m and H is the magnetic field intensity in A/m. In other words, because the electric and magnetic field vector pairs have a similar relationship in an electric dipole antenna and a magnetic dipole antenna, the outward radiating power flow is similar.

An electric monopole (or dipole) and a magnetic dipole may be used to create an antenna. An example of an electric dipole antenna will now be described with reference to FIGS. 3-4.

FIG. 3 illustrates a conventional electric monopole antenna 302 using an electrical monopole to transmit a signal.

As shown in the figure, electric monopole antenna 302 is on a ground plane 304. A transmitter 306 is arranged to provide a current 308 to electric monopole antenna 302. Changes in current 308 generate transmission signals 310 from electric monopole antenna 302.

Consider the situation where current 308 is disposed within electric monopole antenna 302 such that charges resemble the electric dipole discussed above with reference to FIG. 1. In this manner, power will radiate outwardly from electric monopole antenna 302. As the current alternates, the radiating power will similarly alternate, providing transmission signals 310, which radiate outwardly. In this manner, electric monopole antenna 302 is an active device, transmitting a signal. Electric monopole antenna 302 may also perform as a passive device, receiving a signal.

FIG. 4 illustrates conventional electric monopole antenna 302 using an electrical monopole to receive a signal.

As shown in the figure, electric monopole antenna 302 is on a ground plane 304. A receiver 406 is arranged to receive a current 408 from electric monopole antenna 302. Received signals 410 generate changes in current 408, which are provided to receiver 406.

Signals 410 are electromagnetic waves. Electric monopole antenna 302 includes a conducting material. The interaction of signals 410 effect electrons within the conducting material of electric monopole antenna 302 to produce an overall charge therein. Consider the situation where such charges disposed within electric monopole antenna 302 resemble the electric dipole discussed above with reference to FIG. 1. As the electromagnetic fields change within signals 410, the magnitude and/or polarity of the charges within electric monopole antenna 302 similarly change. This change in the charge is current 408 (and similarly may be a change in current 408). Receiver 406 is able to receive current 408, and changes therein, to decode signals 410. In this manner, electric monopole antenna 302 is a passive device, receiving a signal. As mentioned above, a magnetic dipole may be additionally be used as an antenna.

An example of a magnetic dipole antenna will now be described with reference to FIGS. 5-7.

FIGS. 5A-C illustrate a conventional stacked magnetic tile core magnetic dipole antenna.

As shown in FIG. 5A, a stacked core 502 includes tile 504, stacked on tile 506, stacked on tile 508, stacked on tile 510. The material in each tile is used to increase magnetic field density.

As shown in FIG. 5B, an electrical excitation component 512 is disposed perpendicular to the length of stacked core 502.

As shown in FIG. 5C, a transmitter 514 is arranged to provide a current 516 to electrical excitation component 512 and then to ground 518. Current 516 generates concentric magnetic field lines, represented by sample dotted line 520, around electrical excitation component 512. The concentric magnetic field around electrical excitation component 512 induces magnetic fields within stacked core 502, wherein the magnetic fields within stacked core 502 exit one end of stacked core 502 and return into the other end of stacked core 502 so as to make a closed loop of field lines, an example of which is represented as represented by field line 522. Here the direction of propagation of the dynamic electromagnetic field associated with field line 522 is normal to the H vector and the E vector associated with field line 522, as represented by arrow 524.

In this example, field line 522 resembles the magnetic dipole discussed above with reference to FIG. 2. In this manner, power will radiate outwardly from stacked core 502.

FIG. 6 illustrates a conventional stacked magnetic tile core magnetic dipole antenna 602 using the magnetic dipole to transmit a signal.

As shown in the figure, conventional stacked magnetic the core magnetic dipole antenna 602 is disposed to receive a current 604 from a transmitter 514. Changes in current 604 generate transmission signals 606 from magnetic dipole antenna 602. In this example, antenna 602 includes stacked core 502 and electrical excitation component 512 of FIG. 5.

Consider the situation where current 604 is fed to magnetic dipole antenna 602 such that generated magnetic dipole fields within stacked core 502 resemble the magnetic dipole fields associated with the magnetic dipole discussed above with reference to FIG. 2. In this manner, power will radiate outwardly from magnetic dipole antenna 602. As the current alternates, the radiating power will similarly alternate, providing transmission signals 606, which radiate outwardly. In this manner, magnetic dipole antenna 602 is an active device, transmitting a signal. Magnetic dipole antenna 602 may also perform as a passive device, receiving a signal.

FIG. 7 illustrates conventional stacked magnetic tile core magnetic dipole antenna 602 using the magnetic dipole to receive a signal.

As shown in the figure, conventional stacked magnetic tile core magnetic dipole antenna 602 is arranged to receive signals 702. Changes in signals 702 generate changes in a current 704, which is provided to a receiver 706.

Signals 702 are electromagnetic waves With additional reference to FIG. 5, the interaction of signals 702 induces magnetic fields within the material of stacked core 502. The magnetic fields within stacked core 502 induce a current in electrical excitation component 512. As the electromagnetic fields change within signals 702, the magnitude and/or polarity of the magnetic fields within stacked core 502 similarly change This change in the magnetic fields corresponds to current 704. Receiver 706 is able to receive current 704, and changes therein, to decode signals 702, In this manner, magnetic dipole antenna 602 is a passive device, receiving a signal.

The physical and functional differences between an electric monopole antenna and a magnetic dipole antenna produce different transmission results. These differences will now be described with reference to FIG. 8.

FIG. 8 is a graph 800 illustrating gain as a function of angle for an electric monopole antenna and a stacked antenna.

As shown in the figure, graph 800 includes a y-axis 802 measuring gain in dB, and an x-axis 804 measuring an angle in degrees (from zenith, or along the axis of the electric monopole or magnetic dipole). Graph 800 includes a function 806 and a function 808.

Function 806 corresponds to vertical elevation cut of the radiation performance of a vertical electric monopole antenna 822, as shown to the left of graph 800. Function 806 additionally corresponds to fields discussed above with reference to FIG. 1. Function 806 has a maximum gain at approximately 45° (from zenith) indicated at point 810 and approximately −45° (from zenith) indicated at point 812. The gain drops at 0° (zenith) indicated at point 814, at −180° (nadir) shown at point 816 and at 180° (nadir, not shown), because the radiation is not in the direction along the axis of the electric monopole.

Function 808 corresponds to a vertical elevation cut of the radiation performance of a horizontal magnetic dipole antenna 824, as shown to the right of graph 800 Function 808 additionally corresponds to fields discussed above with reference to FIG. 2. The field distribution and polarization is exactly what one would expect from a magnetic dipole antenna. Function 808 has a maximum gain at approximately 0° (zenith) indicated at point 818. The gain drops at approximately −135° indicated at point 820, and at approximately 135° (not shown), because the horizon is at ±90°, and very little power radiates behind the finite ground plane. Only a small amount of power is diffracted around the ground plane edges, creating the −10 dBi backlobe at nadir.

As shown in FIG. 8 the gain as a function of the angle from azimuth is different for a magnetic dipole antenna as compared to that of an electric monopole antenna. These different gain functions may have different optimal applications. On the other hand, a tall narrow stick-like shape of an electric monopole antenna is quite different from the shape of a stacked-core, bar shape of a magnetic dipole antenna, for example as shown in FIG. 5C. These different shapes may have different optimal applications. There may be situations where the gain function of an electric monopole antenna is desired, but the smaller height of the magnetic dipole antenna is also desired.

What is needed is an antenna that provides a transmission function similar to a conventional electric monopole antenna, but without the large height associated with the conventional electric monopole antenna.

BRIEF SUMMARY

The present invention provides an antenna that has a transmission function similar to a conventional electric monopole antenna, but without the large height associated with the conventional electric monopole antenna.

An aspect of the present invention is drawn to an antenna including an electrical excitation component and a core component. The electrical excitation component has an input, an output and a conducting component. The conducting component is disposed between the input and the output and can conduct current from the input to the output. The core component has a wound magnetic film having a substrate and a magnetic material layer. The core component can have a magnetic current loop induced therein. The electrical excitation component is arranged such that concentric magnetic fields associated with current conducted through the electrical excitation component are additionally associated with a magnetic current loop within the core component.

Additional advantages and novel features of the invention are set forth in part in the description which follows, and in part will become apparent to those skilled in the art upon examination of the following or may be learned by practice of the invention. The advantages of the invention may be realized and attained by means of the instrumentalities and combinations particularly pointed out in the appended claims.

BRIEF SUMMARY OF THE DRAWINGS

The accompanying drawings, which are incorporated in and form a part of the specification, illustrate an exemplary embodiment of the present invention and, together with the description, serve to explain the principles of the invention. In the drawings.

DETAILED DESCRIPTION

The present invention is drawn to a magnetic loop antenna that behaves as a mathematical dual of a conventional electric monopole antenna. Lately, the use of magneto-dielectric materials is reported to show promise for increasing the antenna gain-bandwidth product. Others have presented a low-loss, low-profile antenna based on a lossy magneto-dielectric material: a Ni—Zn ferrite operating in its dispersion region. The antenna behaves as a magnetic dipole and a radiation efficiency of almost 65% is obtained at a frequency for which the loss tangent of the material is greater than 10.

Aspects of the present invention are drawn to a magnetic loop antenna that includes a core of multiple magneto-dielectric material layers. Example embodiments include material layers between 0.1 microns and 52 microns (i.e., 0.004 mils and 2 mil, a layer thickness range of more than 500:1). In some embodiments, each material layer is homogeneous and isotropic and may be a metal, metal alloy, dielectric or magneto-dielectric. In some embodiments, each material layer is disposed on a substrate. The material layers may be sputtered onto the substrate via cathode and anode, or otherwise chemically deposited on either constitutive layers or sacrificial layers that are removed during finishing. The final assembly has the characteristics of an inhomogeneous material with desired anisotropic characteristics. These materials can be shaped into many different geometries suitable for obtaining various impedance bandwidths and desired electric and magnetic field orientations. The material shapes are excited by using magnetic flux coupling loops that convert an electric voltage on a coaxial line (volts) to magnetic flux (volt-sec) in the material.

Figure 9:
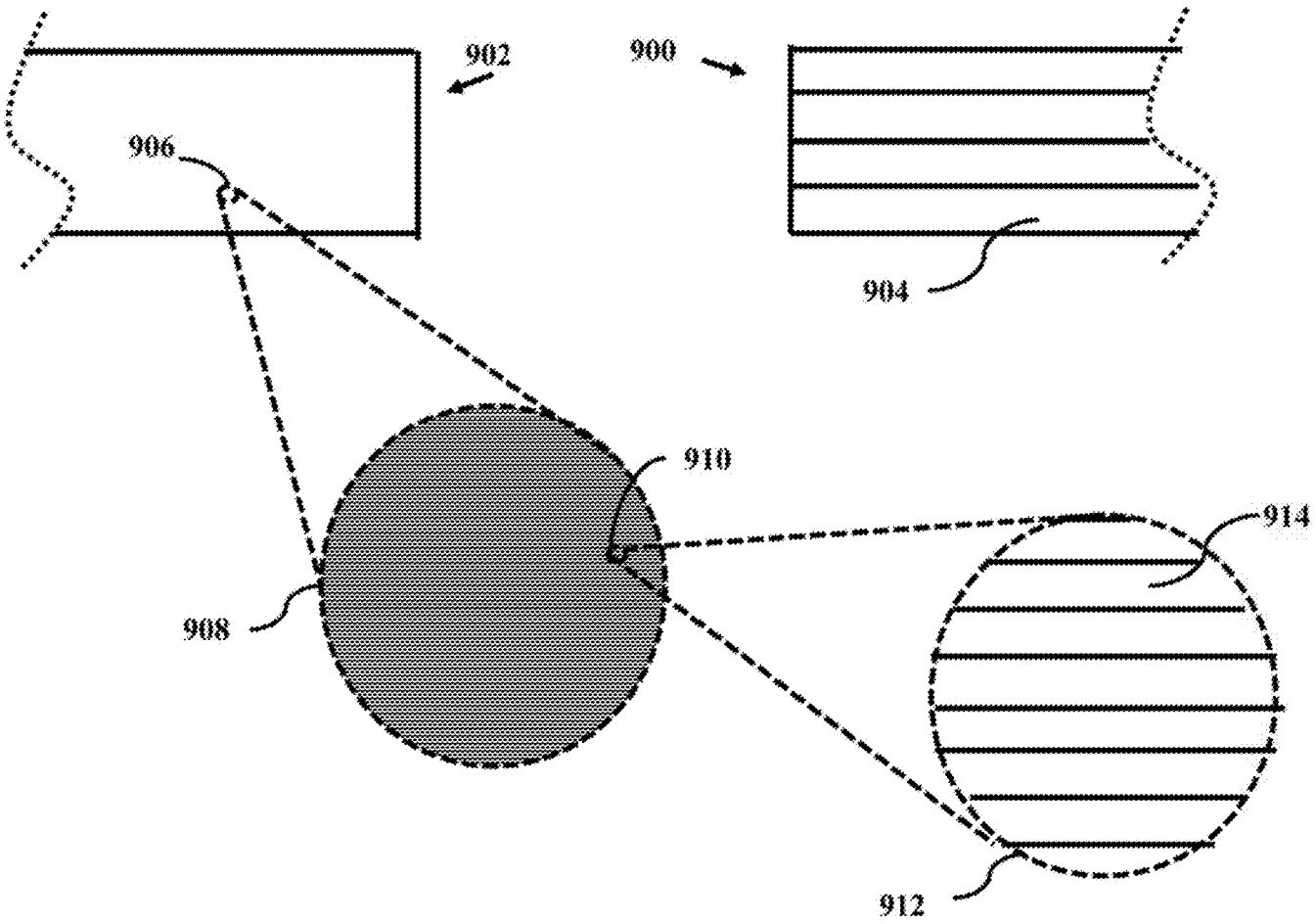
FIG. 9 illustrates a side view of an example stacked film for use in an antenna and a conventional stacked magnetic tile core for use in an antenna.

FIG. 9 illustrates a side view of a conventional stacked magnetic tile core 900 for use in an antenna and a theoretical stacked film 902 for use in an antenna.

As shown in the figure, conventional stacked magnetic tile core 900 includes a plurality of magnetic material tiles, an example of which is indicated as tile 904. An exploded view of circular portion 906 of theoretical stacked film 902 is shown as circular portion 908. An exploded view of circular portion 910 is shown as circular portion 912.

Stacked magnetic tile core 900 provides magnetic field lines within each tile, in a direction along the length of the tiles. In this example, let each magnetic material tile in stacked magnetic tile core 900 be 0.25 in. As the thickness of each tile increases, there is a corresponding increase in unwanted eddy currents. These eddy currents produce heat within the tiles, thus reducing the overall Q factor of the stacked magnetic tile core 900. The Q factor can generally be considered the quality of resistance to resonance, wherein a higher Q factor translates into a better magnetic core component for an antenna. Therefore, one way to increase the Q factor is to decrease the thickness of each magnetic tile. This may be accomplished by using films as opposed to tile, which leads to the theoretical stacked film 902.

Stacked film 902 includes a plurality of film layers, an example of which is labeled as 914. In this example, let each film layer be approximately 25 microns thick. Because each film in stacked film 902 is orders of magnitude less in thickness as compared to each magnetic material tile in stacked magnetic tile core 900, stacked film 902 would have orders of magnitude less eddy currents. As such, stacked film 902 would theoretically have a much higher Q than stacked magnetic tile core 900.

Figure 10:
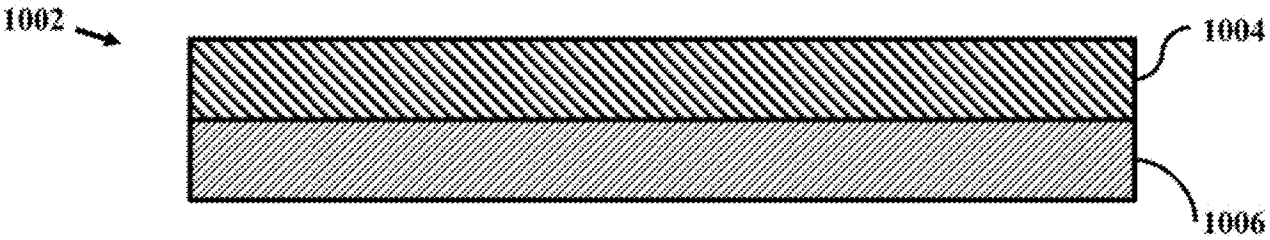
FIG. 10 illustrates a side view an example stacked film for use in a stacked film antenna.

FIG. 10 illustrates a side view of an example film 1002 for use in a theoretical stacked film antenna. Film 1002 includes a layer 1004 of magnetic material disposed on a substrate 1006. In this example, layer 1004 and substrate. 1006 have an equal thickness. Substrate provides structural support for layer 1004. Further, when film 1002 is stacked upon another similar film, substrate 1006 separates layer 1004 from the adjacent magnetic material layer. This separation insulates the two magnetic. material layers, which prevents adjacent conducting layers from touching and conducting, between each other. As such, any generated eddy currents are trapped within a single layer of conductor. The separation is important, yet the actual thickness of substrate 1006 does not need to equal layer 1004.

Figure 11:
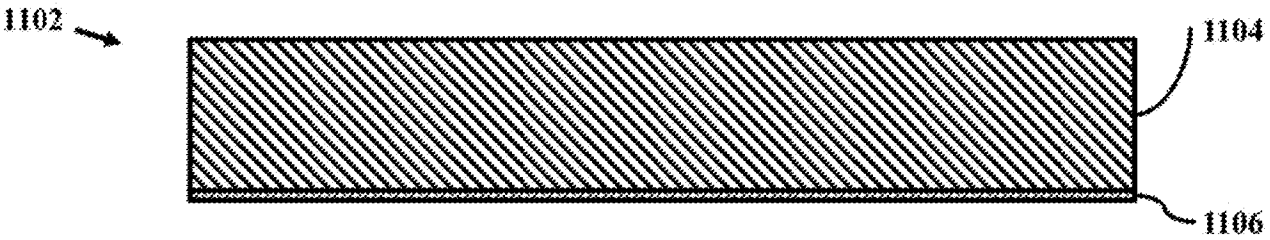
FIG. 11 illustrates a side view an example stacked film for use in a stacked film antenna.

FIG. 11 illustrates a side view of an example film 1102 for use in a stacked film antenna. Film 1102 includes a layer 1104 of magnetic material disposed on a substrate 1106. In this example, layer 1104 is much thicker than substrate 1106. Again, substrate provides separation of adjacent magnetic material layers, when the films are stacked. However, a bulk of the thickness of film 1102 corresponds to the magnetic material such that a large amount of magnetic field lines may be generated. Minimization of substrate layer thickness achieves greater magnetization but must be traded with its ability to support sputtered films while under tension.

Fabrication of a theoretical stacked film core for use in a magnetic dipole antenna will now be described with reference to FIGS. 12-13.

Figure 12:
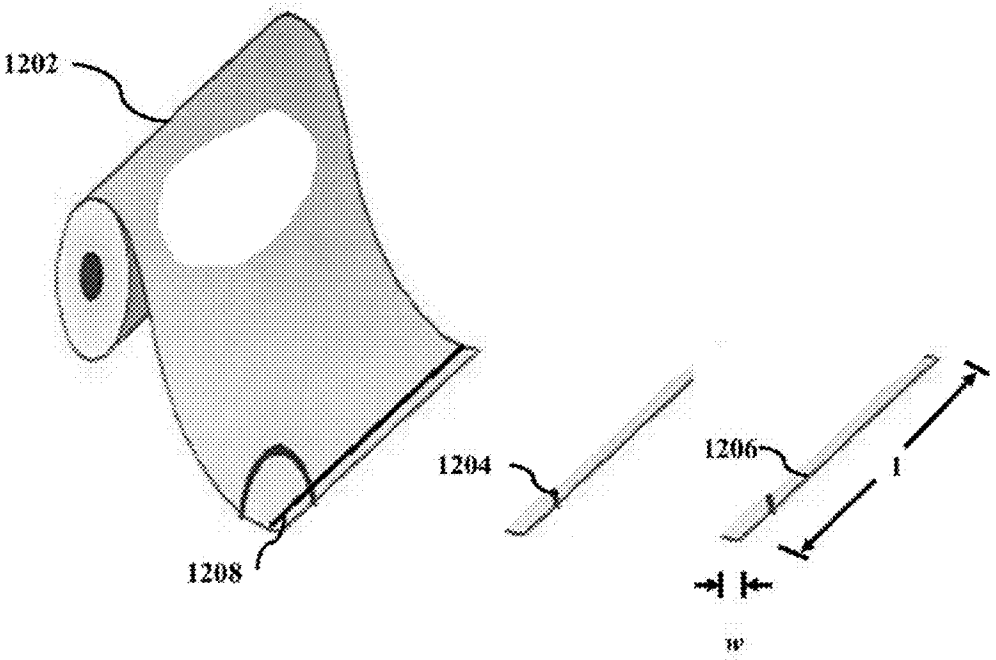
FIG. 12 illustrates a roll of magnetic film to be cut to form a stacked film core.

FIG. 12 illustrates a roll 1202 of magnetic film to be cut to form a stacked film core.

As shown in the figure, a line 1208 indicates where magnetic film of roll 1202 will be cut, whereas portion 1204 and portion 1206 have already been cut. In this example roll 1202 has a length l, and each cut portion will have a width w, such that a resulting stacked film core would have a length l and width w. Currently, there is only one machine in the world can deposit a magnetic material as a coating at 0.1 microns in industrial quantities, and the film manufacturer only makes the film in one width. The length of the roll, the thickness of the film, and the thickness of the metal coating are buyer-specified, within the operational bounds established by the factory.

By stacking up the film, e.g., portions 1204 and 1206, a bar core may provide a net magnetization, due to the volume (height) dilution factor of film-to-coating thickness. From required known design parameters, the required cross-section of the antenna may be determined. One possible implementation would be to stack up individual sheets of material and bond them together then cut out an antenna from that stack. This is wasteful of the (expensive) raw material. Further, there are problems with stacking the fragile portions of film, as will now be described with reference to FIG. 13.

Figure 13:
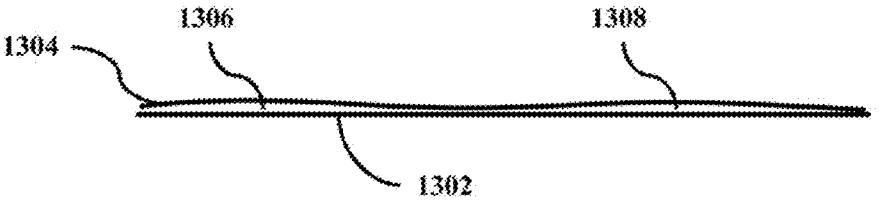
FIG. 13 illustrates a side view of stacked films used in formation of a stacked film core.

FIG. 13 illustrates a side view of films 1302 and 1304 used in formation of a stacked film core.

Let the thickness of each of films 1302 and 1304 be on the order of 25 microns. Because these films are so thin and because of an inherent tension obtained from the roll processing steps, they tend to curl at the edges or crinkle, thus leaving spaces 1306 and 1308 between them in an attempt to stack. These spaces negatively affect the overall ability of each layer to couple with outside magnetic fields. It is this reason that the stacked film core discussed above with respect to FIGS. 9-12 is referred to as a "theoretical" stacked film core. In particular, it is impractical to actually fabricate. Nevertheless, the magnetic film layers may be stacked in another way to form a magnetic antenna.

In accordance with aspects of the present invention, a magnetic loop core formed of a plurality of magnetic layers may be used to create an antenna. An example of magnetic loop antenna in accordance with aspects of the present invention will now be described with reference to FIGS. 14-26.

Figure 14:
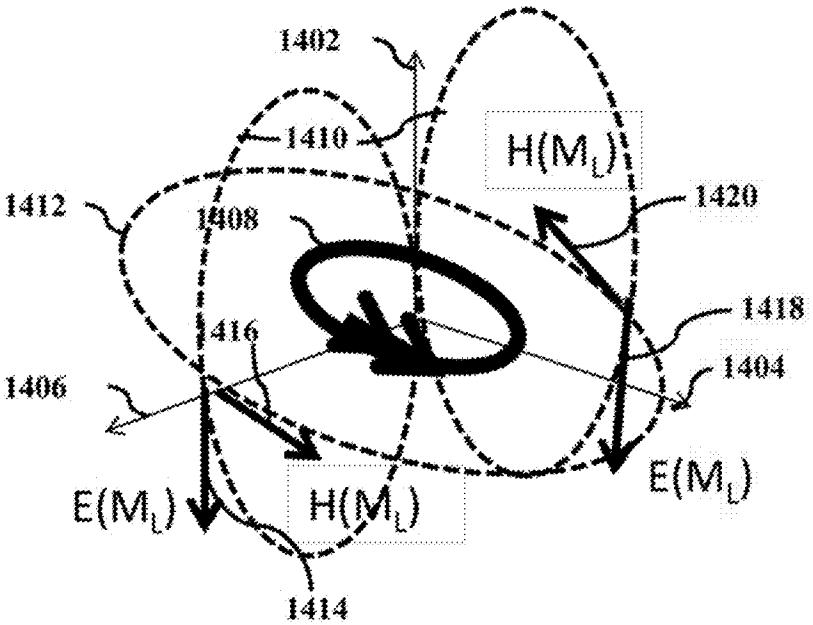
FIG. 14 illustrates a magnetic loop and the electric and magnetic fields associated therewith.

FIG. 14 illustrates a magnetic loop 1408 and the electric and magnetic fields associated therewith.

As shown in the figure, a z-axis 1402, an x-axis 1406 and a y-axis 1404 create a coordinate system. Magnetic loop 1408 is disposed about z-axis 1402 on the plane made by x-axis 1406 and y-axis 1404. Magnetic loop 1408 has an associated electric field, represented by sample lines 1410, which have a concentric magnetic field, represented by sample line 1412. A resulting E, H vector pair is shown as lines 1414 and 1416 respectively, and another resulting E, H vector pair is shown as lines 1418 and 1420, respectively. The vector cross product of E and H describe power flow that is radially outward from magnetic loop 1408.

Figure 2:
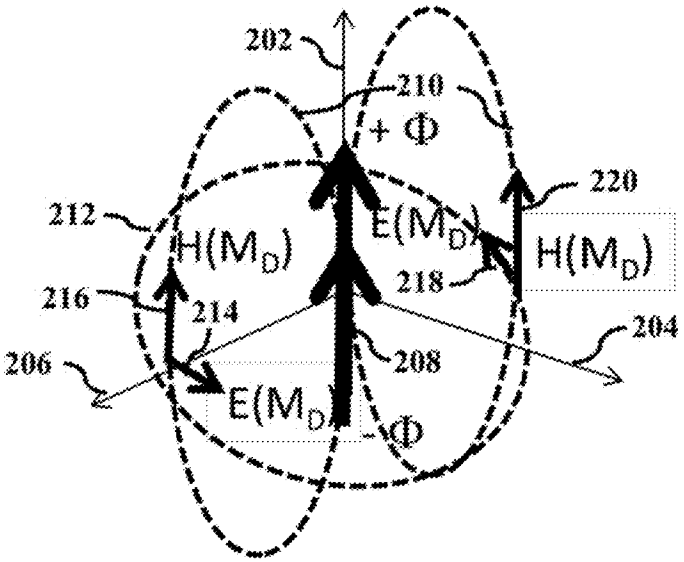
FIG. 2 illustrates a magnetic dipole and the electric and magnetic fields associated therewith.
Figure 1:
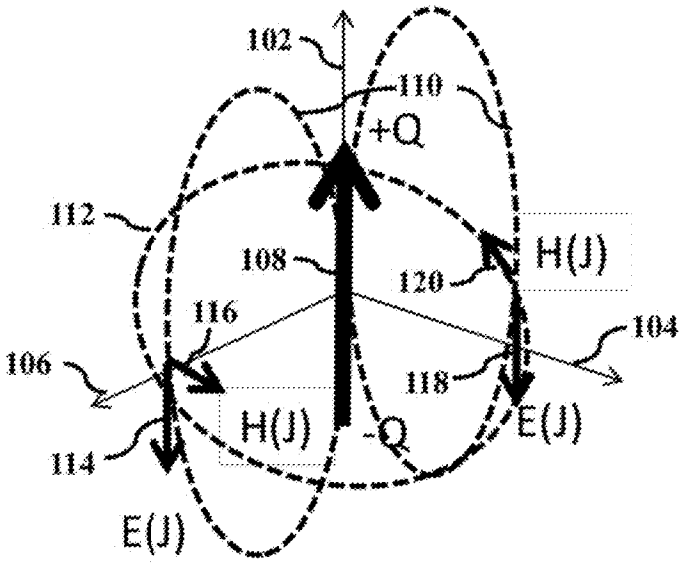
FIG. 1 illustrates an electrical dipole and the electric and magnetic fields associated therewith.
Figure 4:
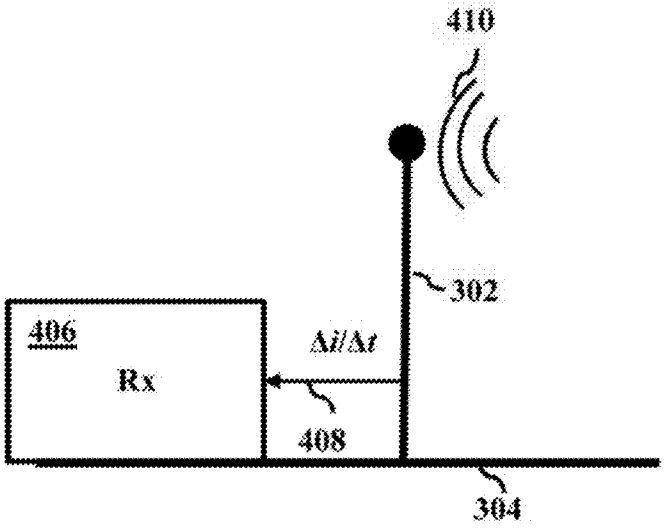
FIG. 4 illustrates the conventional electric monopole antenna, of FIG. 3, using an electrical dipole to receive a signal.
Figure 3:
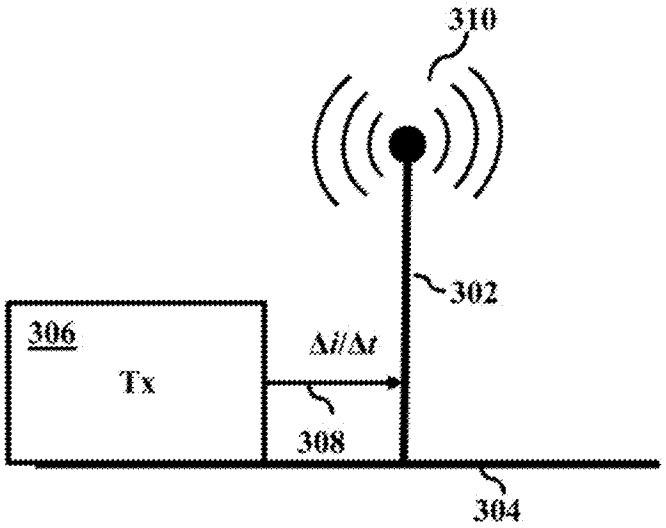
FIG. 3 illustrates a conventional electric monopole antenna using an electrical dipole to transmit a signal.
Figure 5A:
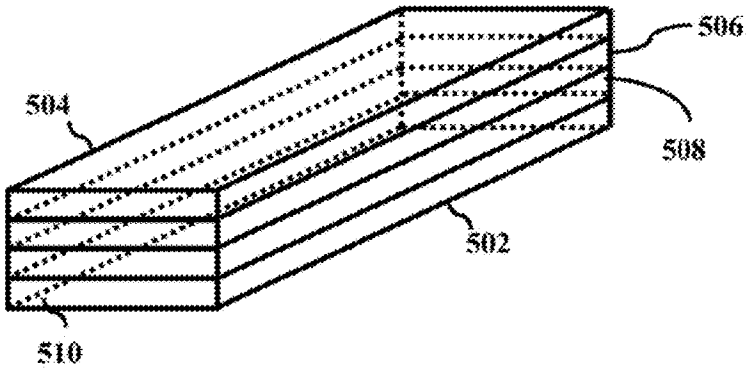
FIGS. 5A-C illustrate a conventional stacked antenna using a magnetic dipole.
Figure 5B:
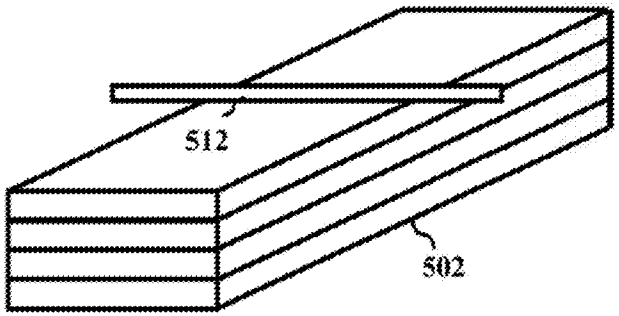
Figure 5C:
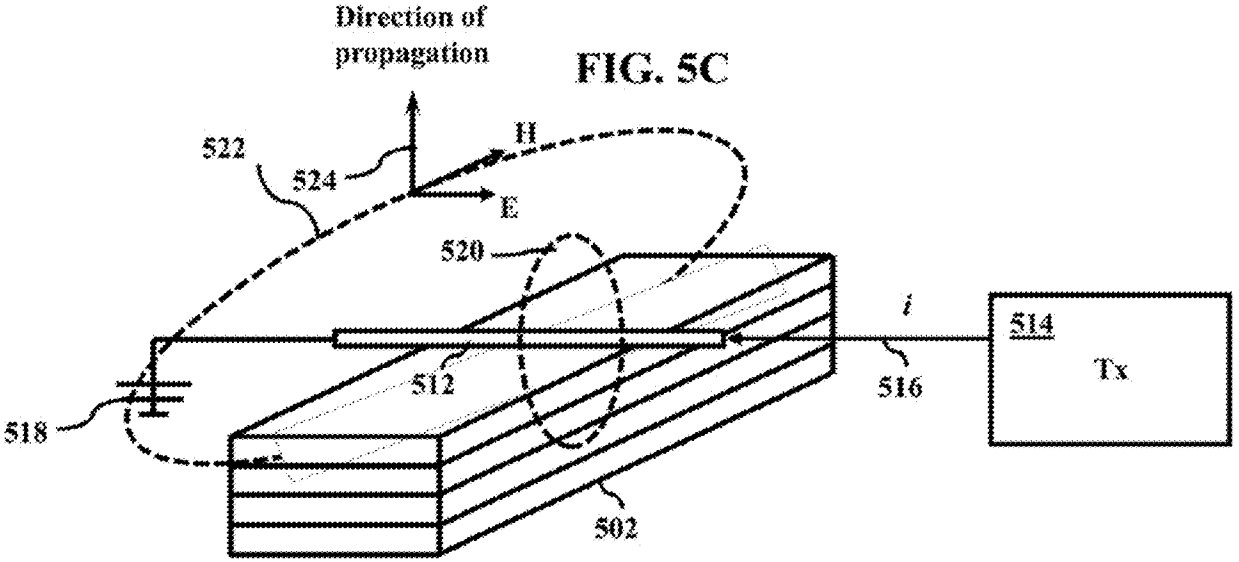
Figure 7:
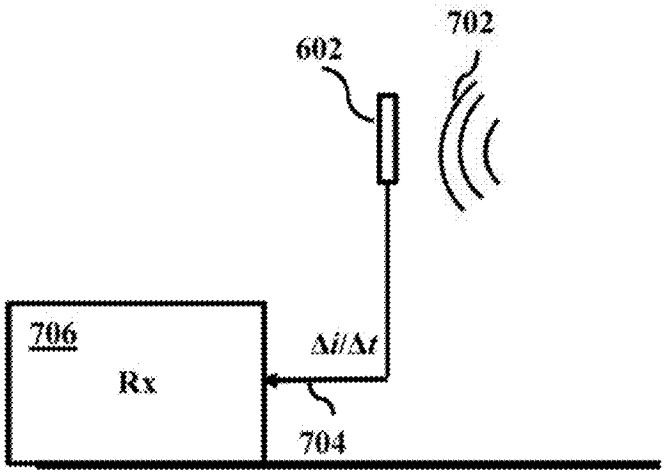
FIG. 7 illustrates the conventional stacked antenna, of FIG. 5C, using the magnetic dipole to receive a signal.
Figure 6:
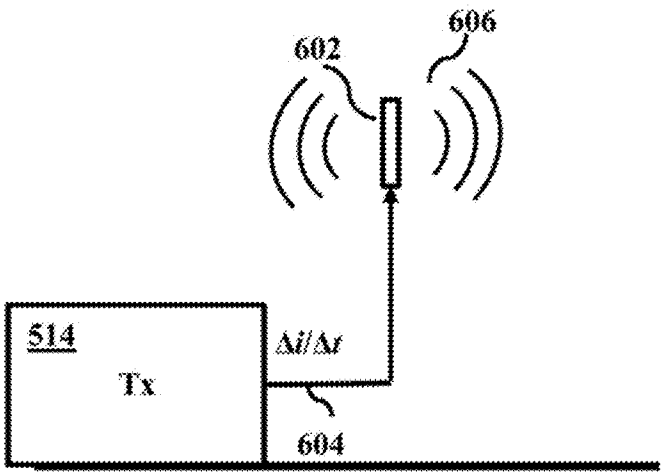
FIG. 6 illustrates the conventional stacked antenna, of FIG. 5C, using the magnetic dipole to transmit a signal.
Figure 8:
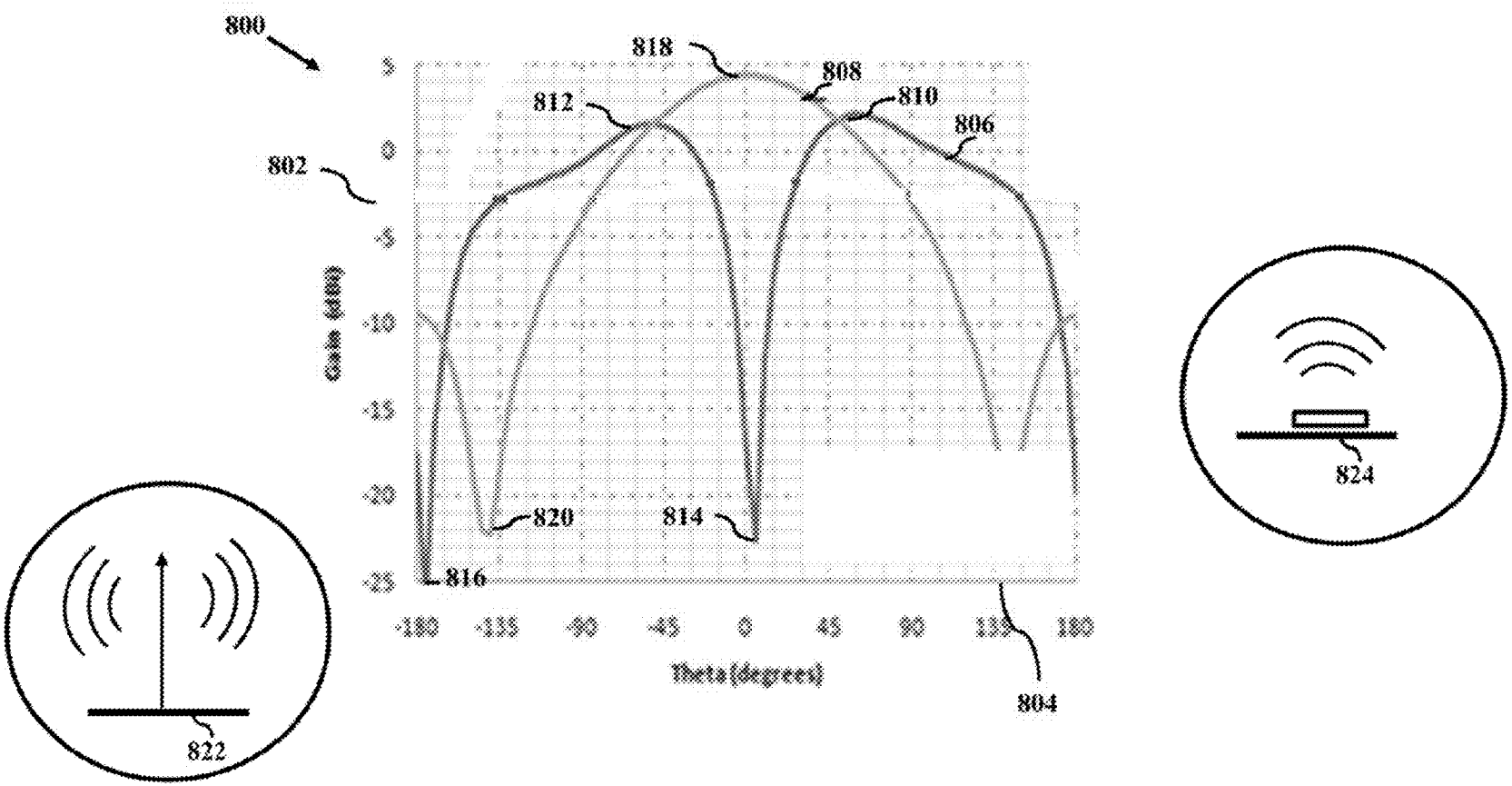
FIG. 8 is a graph illustrating gain as a function of angle for an electric monopole antenna, a stacked free-space antenna, and a stacked antenna.

The fields of magnetic loop 1408 are identical to those of electric monopole 108 of FIG. 1, if $M_L$=J. Of particular interest is the case when magnetic loop 1408 is placed on a perfect electric conductor (PEC) ground plane. A PEC is a theoretical abstraction. It is: 1) perfectly conducting, which means zero loss and zero skin depth; and 2) it extends to infinity. In this case, any voltage induced across the PEC will produce an infinite current, which will exactly cancel the applied voltage. Thus the tangential voltage vector across any PEC shall always be zero. Tangential magnetic currents may flow against a PEC, and this is achieved with an antenna in accordance with the present invention. In that case, loop 1408 becomes equivalent to an electric monopole excited perpendicular to the perfect electric ground plane.

In accordance with aspects of the present invention, a magnetic loop may be implemented via a magnetic core component. This will now be described with reference to FIGS. 15-17.

Figure 15:
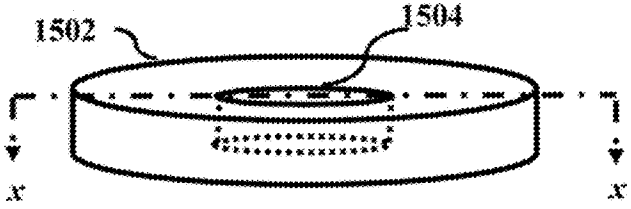
FIG. 15 illustrates an example core component in accordance with aspects of the present invention.

FIG. 15 illustrates an example core component 1502 in accordance with aspects of the present invention. Core component 1502 has a circular shape with a hole 1504 at its center.

Figure 16:
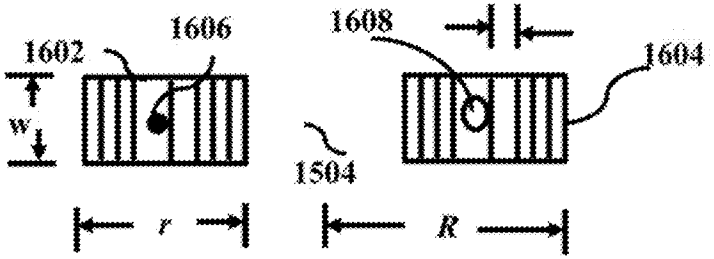
FIG. 16 illustrates a cross sectional view of the core component of FIG. 15, as cut through line x-x.

FIG. 16 illustrates a cross sectional view of core component 1502 of FIG. 15, as cut through line x-x.

As shown in FIG. 16, core component 1502 has a cross-sectional portion 1602 and and a cross-sectional portion 1604 about hole 1504.

Core component 1502 includes wound magnetic film, one layer of which is labeled as 1602. Each layer includes a substrate and a magnetic material layer, similar to that discussed above with reference to FIGS. 10-11. As a result of this structure, core component 1502 is able to have a magnetic current loop induced therein. In FIG. 16, a magnetic loop is indicated in layer 1602 as dot 1606 and corresponding circle 1608 shown in cross-sectional portion 1604. In this example, dot 1606 represents the magnetic field loop entering the page, whereas circle 1608 represents the loop leaving the page, wherein the magnetic field loop would have a clockwise polarity as viewed with reference to FIG. 15.

Figure 17:
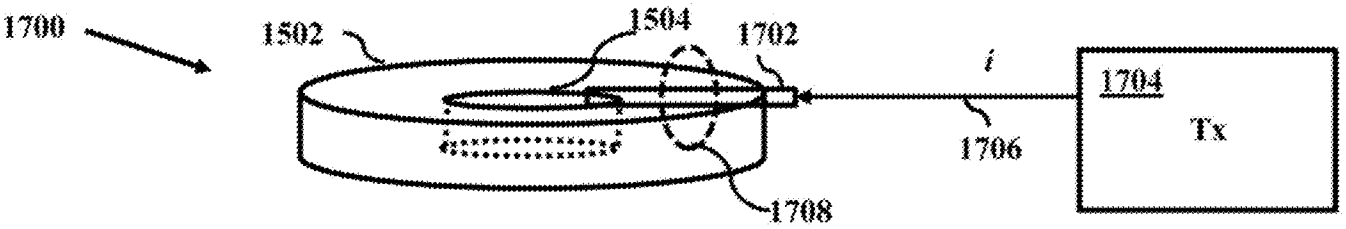
FIG. 17 illustrates an example transmission system in accordance with aspects of the present invention.

FIG. 17 illustrates an example transmission system 1700 in accordance with aspects of the present invention.

As shown in the figure, transmission system 1700 includes core component 1502, an electrical excitation component 1702 and a transmission component 1704. Transmission component is arranged to provide a current 1706 to electrical excitation component 1702. Current passing through electrical excitation component 1702 generates associated concentric magnetic fields, a sample of which is indicated by dotted line 1708. The concentric magnetic fields couple into core component 1502 to induce a magnetic field loop within core component 1502. Magnetic field loops within core component 1502 may be exploited to transmit or receive electromagnetic signals as an antenna. Before discussing how core component 1502 may be used to transmit/receive signals, a method of making a magnetic loop core component will be discussed.

An example method of making a magnetic loop antenna in accordance with aspects of the present invention will now be described with reference to FIGS. 18-22.

Figure 18:
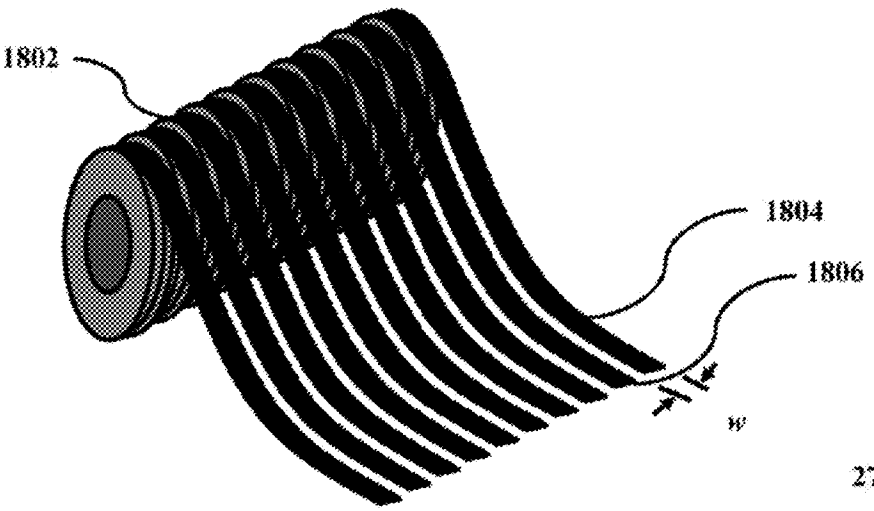
FIG. 18 illustrates an example roll of magnetic film to be cut to form a core component in accordance with aspects of the present invention.

FIG. 18 illustrates an example roll 1802 of magnetic film as cut to form a core component in accordance with aspects of the present invention.

In an example embodiment, the magnetic film of roll 1802 includes a magnetic material layer disposed on a substrate layer similar in structure to the films discussed above with reference to FIGS. 9-10. Non-limiting examples of the magnetic material layer include one of the group consisting of NiZn ferrite. $Co_2Z$ hexaferrite, CoFeSiNoB ferromagnetic metal alloy, CoZrNb ferromagnetic metal alloy, and combinations thereof.

Roll 1802 may be a rolled sheet of film as discussed above with reference to FIGS. 10-11. Roll 1802 is cut along lines perpendicular to the axis of roll 1802 into strips, examples of which are labeled 1804 and 1806. This method of cutting roll 1802 is contrary to the method discussed above with reference to FIG. 12, wherein roll 1202 was cut along lines parallel with the axis of roll 1202.

Each strip has a width corresponding to the height of a core component, as will be described in more detail later. In this non-limiting example, each strip of roll 1802 has an equal width w. However in other examples, many different width strips may be cut in order to form core components having different heights. Once a sheet of film has been cut, a core component may be fabricated. An example method of which will now be described in greater detail with reference to FIGS. 19-20.

Figure 19:
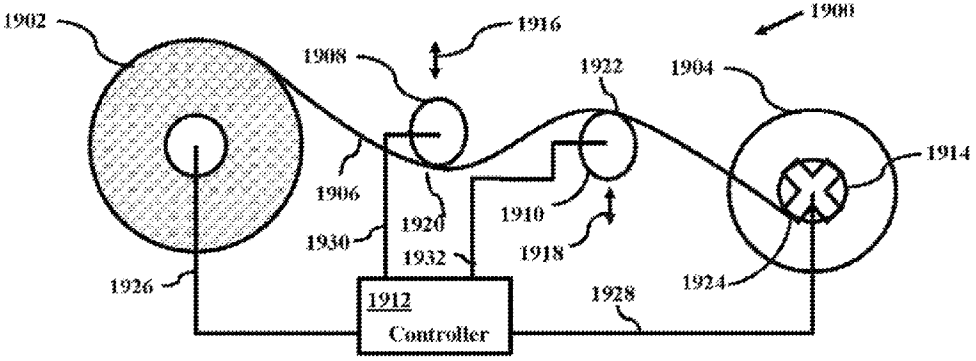
FIG. 19 illustrates an example system, at time $t_0$, for forming a core component in accordance with aspects of the present invention.

FIG. 19 illustrates an example system 1900, at time $t_0$, for forming a core component in accordance with aspects of the present invention.

As shown in the figure, system 1900 includes a roll 1902 of magnetic film, a receiving blank 1904, a tension roller 1908, a tension roller 1910 and a controller 1912. Receiving blank 1904 includes a mandrel 1914, centrally located thereon.

Roll 1902 is a roll of film to be used to fabricate a magnetic loop core. Roll 1902 is rotatable, so as to unroll film 1906 therefrom. Let roll 1902 be a film of the type discussed above with reference to FIGS. 10-11, and cut from a sheet of a type discussed above with reference to FIG. 18. In one example, roll 1902 may be strip 1804 repackaged into a roll of film after being sliced from roll 1802. Roll 1902 may additionally be a plurality of strips that have been joined by any known method, non-limiting examples of which include using adhesives, heating, and combinations thereof. In another example, roll 1902 may include strip 1804 joined with strip 1806, so as to double the total length of film.

Since the magnetic antennas will be fabricated by standing the films on edge, the width w of the cut film is chosen to be equal to the vertical antenna height as desired. In this example, the resulting magnetic loop core component will have a height equal to w of strip 1804.

Tension roller 1908 can rotate and is able to move up and down in a direction indicated by double arrow 1916. Film 1906 is able to pass under rolling tension roller 1908 at location 1920. Tension roller 1910 can rotate and is able to move up and down in a direction indicated by double arrow 1918. Film 1906 is able to pass over rolling, tension roller 1910 at location 1922, As such, the tension of magnetic film 1906 may he managed by moving either or both of tension roller 1908 and tension roller 1910 in a respective direction. Tension roller 1908 and tension roller 1910 are non-limiting examples of known tension management devices. Any known device for maintaining a predetermined tension may be used so as to prevent film 1906 from buckling or curling as it winds around mandrel 1914.

Receiving blank 1904 is rotatable. Mandrel 1914 is able to have an end of film 1906 anchored thereto at location 1924, by any known anchoring method or system, non-limiting examples of which include an adhesive, magnetically, a slit for which film 1906 may be inserted, or a grabbing mechanism. Mandrel 1914 may be any shape. In this non-limiting example embodiment, mandrel 1914 is circular.

Film 1906 is unrolled from roll 1902, is fed by tension roller 1908, is fed by tension roller 1910 and is anchored onto mandrel 1914.

Controller 1912 is able to: control roll 1902 via communication channel 1926; control receiving blank 1904 via communication channel 1928; control tension roller 1908 via communication channel 1930 and control tension roller 1910 via communication channel 1932. Each of communication channels 1926, 1928, 1930 and 1932 may be any known type of wired or wireless communication channel.

Controller 1912 is able to control the rate at which roller 1902 unrolls the film and is able to control the rate at which receiving blank 1904 winds the film. Controller 1912 is additionally able to control the amount of movement of tension roller 1908 along the direction of double arrow 1916 and to control the amount of movement of tension roller 1910 along the direction of double arrow 1918.

Figure 20:
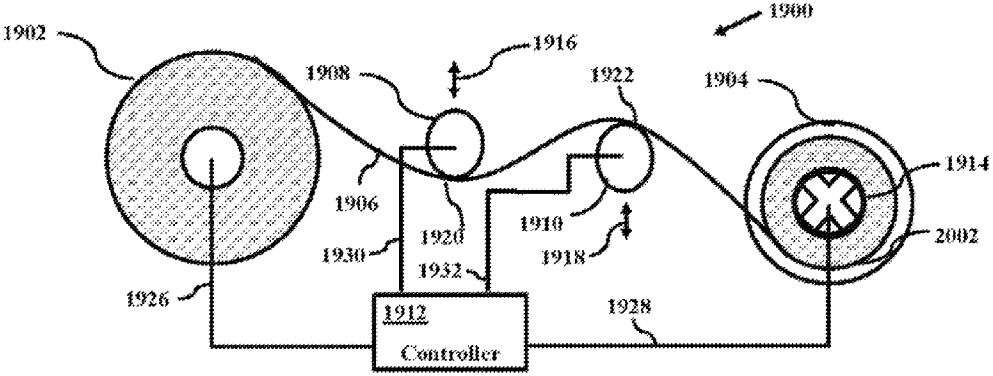
FIG. 20 illustrates the example system of FIG. 19, at time $t_1$, for forming a core component in accordance with aspects of the present invention.

FIG. 20 illustrates example system 1900, at time $t_1$, for forming a core component in accordance with aspects of the present invention.

As film 1906 unrolls from roll 1902, it eventually winds around mandrel 1914 to from a magnetic loop core, an incomplete portion of which is indicated in FIG. 20 as core portion 2002. Controller 1912 positions tension rollers 1908 and 1910 so as to ensure film 1906 does not crinkle, fold or bunch as it is wound about mandrel 1914. As such, this method of creating layers of film avoids the problems associated with the stacked film core discussed above with reference to FIG. 13. Further, inter-layer adhesives are not needed to maintain core component by winding around mandrel 1914. This is a beneficial aspect, as inter-layer adhesives are not desirable because they decrease the overall Q of the core component. Once the core component is complete, e.g. the number of windings reaches a total required thickness in the core component, locally arranged electromagnets (not shown) may be used to hold a film to its desired mandrel form. At that point, a compression form may be used to hold the wound core component on mandrel 1914.

The magnetic core component winding process described above with reference to FIGS. 19-20 may produce a less than optimal magnetic core component. In particular, tension rollers 1908 and 1910 contacting film 1906 may damage film 1906. Further any particulates that accumulate on tension rollers 1908 and 1910 may be transferred to film 1906, which will decrease the homogeneity of the final magnetic core component. To avoid these problems, another example method of manufacturing a magnetic core component may be implemented, as will now be discussed with reference to FIG. 21.

Figure 21:
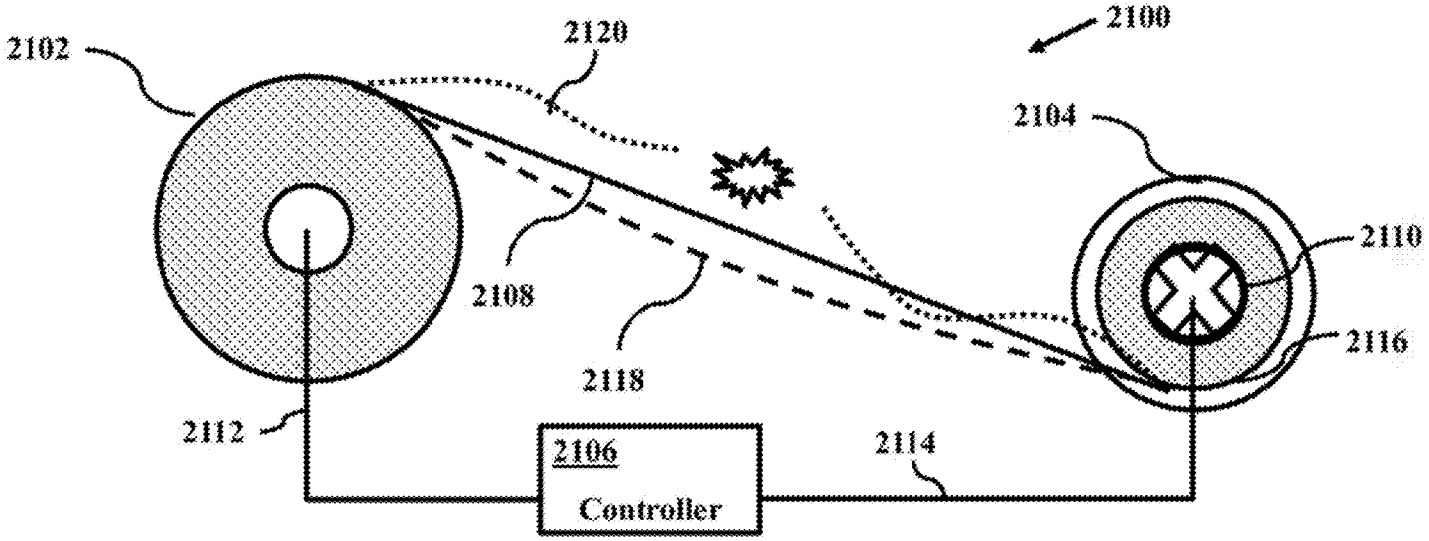
FIG. 21 illustrates another example system, at time $t_1$, for forming a core component in accordance with aspects of the present invention.

FIG. 21 illustrates an example system 2100, at time $t_1$, for forming a core component in accordance with aspects of the present invention.

As shown in the figure, system 2100 includes a roll 2102 of magnetic film, a receiving blank 2104 and a controller 2106. Receiving blank 2104 includes a mandrel 2110, centrally located thereon.

Roll 2102 is a roll of film to be used to fabricate a magnetic loop core and is similar to roll 1902 discussed above with reference to FIGS. 19-20. Roll 2102 is rotatable, so as to unroll film 2108 therefrom.

Receiving blank 2104 is similar to receiving blank 1904 discussed above with reference to FIGS. 19-20. Similarly, mandrel 2116 is similar to mandrel 1914 discussed above with reference to FIGS. 19-20.

Film 2108 is unrolled from roll 2102 and is anchored onto mandrel 2110. In this manner, system 2100 differs from system 1900 in that system 2100 does not include tension rollers.

Controller 2106 is able to control roll 2102 via communication channel 2112 and to control receiving blank 2104 via communication channel 2114. Each of communication channels 2112 and 2114 may be any known type of wired or wireless communication channel.

Controller 2106 is able to detect tension of film 2108 as it is being unrolled from roll 2102 and control the rate at which roller 2102 unrolls the film. Further, controller 2106 is able to detect tension of film 2108 as it is being rolled onto receiving blank 2110 and is able to control the rate at which receiving blank 2110 winds the film.

As film 2108 unrolls from roll 2102, it eventually winds around mandrel 2110 to from a magnetic loop core, an incomplete portion of which is indicated in FIG. 21 as core portion 2116.

Controller 2106 constantly measures the tension on each of roll 2102 and receiving blank 2110 and accordingly adjusts the rotation rate of roll 2102 and the rotation rate of receiving blank 2110 to ensure that film 2108 is within a predetermined acceptable tension thresholds. If the tension of film 2108 drops below a first predetermined acceptable tension threshold, then the film may slack as shown by dashed line 2118. Slack in film 2108 may increase the likelihood of crinkling, twisting or curling of film 2118 while winding about receiving blank 2110, which will decrease the overall Q of the core component. If the tension of film 2108 rises above a second predetermined acceptable tension threshold, then the film may break as shown by dotted line 2120. A break in the film may require fabrication of an entirely new core or a splicing step, which will decrease the overall Q of the core component.

This method of creating layers of film avoids the use of tension rollers, thus avoiding the problems associated with the method discussed above with reference to FIGS. 19-20.

Once the core component is wound, electrical excitation components, e.g., flux coupling loops, may then be added after the winding process. These electrical excitation components may be connected to a power distribution network which can achieve any number of desired modes with the antenna.

Figure 22:
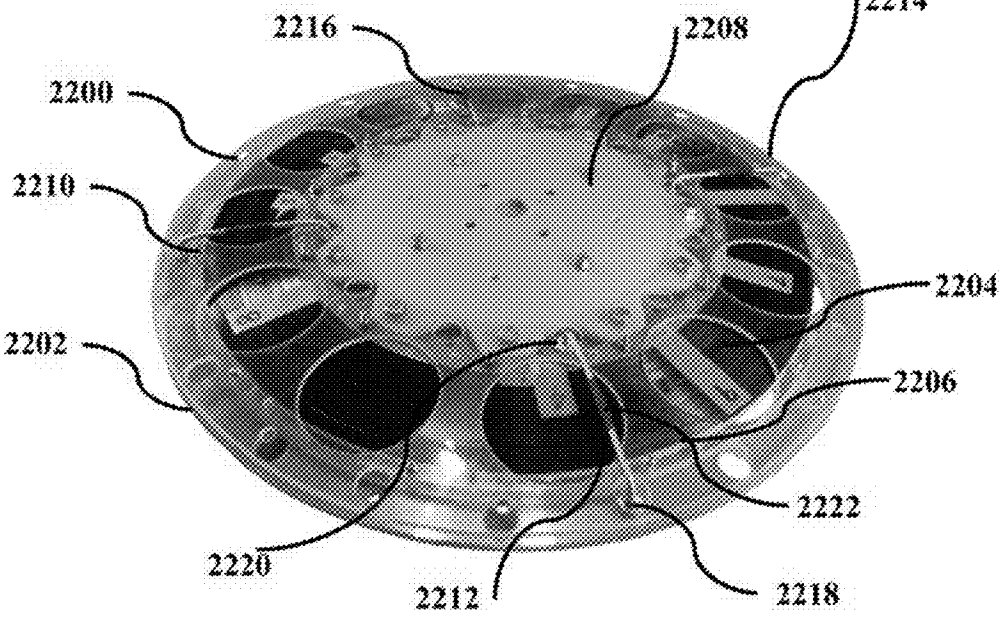
FIG. 22 illustrates an example magnetic loop antenna in accordance with aspects of the present invention.

FIG. 22 illustrates an example magnetic loop antenna 2200 in accordance with aspects of the present invention.

As shown in the figure, antenna 2200 includes a back support 2202, a core component 2204, a front support 2206, a mandrel 2208, an electrical excitation component 2210, an electrical excitation component 2212, and electrical excitation component 2214 and an electrical excitation component 2216.

In this example, back support 2202 corresponds to receiving blank 1904 of FIG. 19 and mandrel 2208 corresponds to mandrel 1914 of FIG. 19. Front support 2206 encloses core component 2204. Although electrical excitation components 2210, 2212, 2214 and 2216 are used in this example, any number of electrical excitation components may be used.

Each of electrical excitation components 2210, 2212, 2214 and 2216 has an input, an output and a conducting component. For example, electrical excitation component 2212 has an input 2218, an output 2220 and a conducting component 2222. Conducting component 2222 is disposed between the input and the output and is able to conduct current from the input to the output. In this manner, electrical excitation component 2212 is able to induce a magnetic loop within core component 2204 in a manner similar to that discussed above with reference to FIG. 17.

An example method of operating a magnetic loop antenna in accordance with aspects of the present invention will now be described with reference to FIGS. 23-26.

Figure 23:
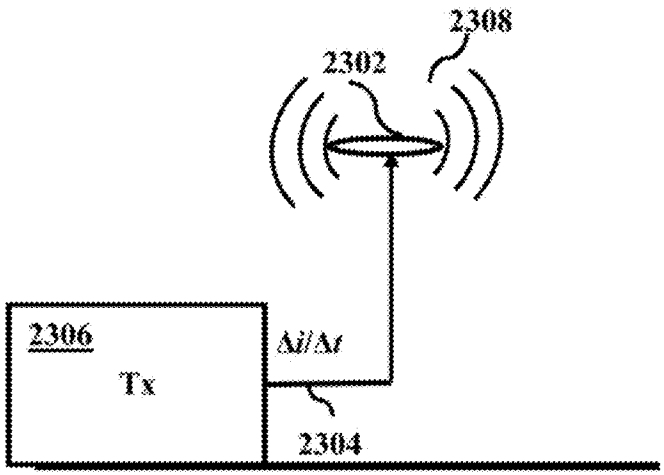
FIG. 23 illustrates a magnetic loop antenna using a magnetic loop to transmit a signal in accordance with aspects of the present invention.

FIG. 23 illustrates a magnetic loop antenna 2302 using a magnetic loop to transmit a signal in accordance with aspects of the present invention.

As shown in the figure, magnetic loop antenna 2302 is disposed to receive a current 2304 from a transmitter 2306. Changes in current 2304 generate transmission signals 2308 from 2302.

Consider the situation where current 2304 is fed to magnetic loop antenna 2302 such that generated magnetic loop within the core component resembles the magnetic loop discussed above with reference to FIG. 14. In this manner, power will radiate outwardly from magnetic loop antenna 2302. As the current alternates, the radiating power will similarly alternate, providing transmission signals 2308, which radiate outwardly. In this manner, magnetic loop antenna 2302 is an active device, transmitting a signal. Magnetic loop antenna 2302 may also perform as a passive device, receiving a signal.

Figure 24:
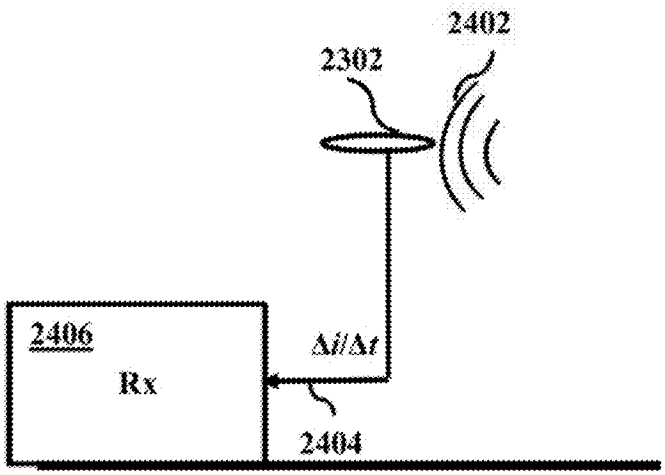
FIG. 24 illustrates the magnetic loop antenna of FIG. 23, using a magnetic loop to receive a signal in accordance with aspects of the present invention.

FIG. 24 illustrates magnetic loop antenna 2302 using a magnetic loop to receive a signal in accordance with aspects of the present invention.

As shown in the figure, magnetic loop antenna 2302 is arranged to receive signals 2402. Changes in signals 2402 generate changes in a current 2404, which is provided to a receiver 2406.

Signals 2402 are electromagnetic waves. The interaction of signals 2402 induces magnetic fields within the magnetic material of the magnetic core of magnetic loop antenna 2302. The magnetic fields within the magnetic core of magnetic loop antenna 2302 induce a current in an electrical excitation component of magnetic loop antenna 2302. As the electromagnetic fields change within signals 2402, the magnitude and/or polarity of the magnetic fields within the magnetic core of magnetic loop antenna 2302 similarly change. This change in the magnetic fields corresponds to current 2404. Receiver 2406 is able to receive current 2404, and changes therein, to decode signals 2402. In this manner, magnetic loop antenna 2302 is a passive device, receiving a signal.

Figure 25:
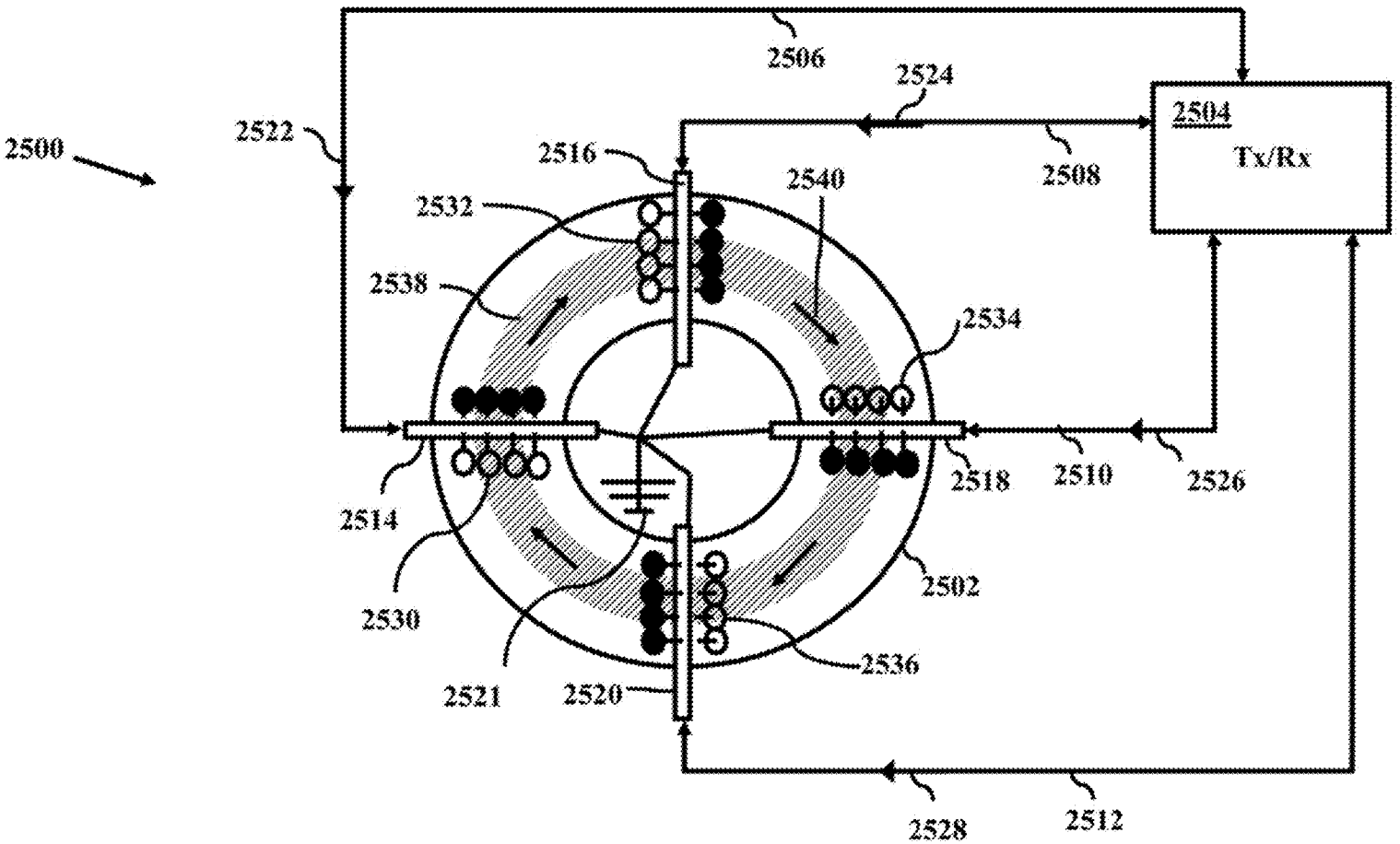
FIG. 25 illustrates a schematic view of an example magnetic loop antenna communication system in accordance with aspects of the present invention, wherein a magnetic loop is traveling in a clockwise direction.

FIG. 25 illustrates a schematic view of an example magnetic loop antenna communication system 2500 in accordance with aspects of the present invention, wherein a magnetic loop is traveling in a clockwise direction.

As shown in the figure, system 2500 includes a core component 2502, a transmitter/receiver 2504, current line 2506, current line 2508, current line 2510, current line 2512, electrical excitation component 2514, electrical excitation component 2516, electrical excitation component 2518, electrical excitation component 2520 and ground 2521.

Transmitter/receiver 250 is arranged such that, in the transmission mode: a current 2522 is provided through current line 2506 to electrical excitation component 2514 and to ground 2521; a current 2524 is provided through current line 2508 to electrical excitation component 2516 and to ground 2521; a current 2526 is provided through current line 2510 to electrical excitation component 2518 and to ground 2521; and a current 2528 is provided through current line 2512 to electrical excitation component 2520 and to ground 2521.

Concentric magnetic field loops 2530 form around electrical excitation component 2514 as a result of current 2522. Concentric magnetic field loops 2532 form around electrical excitation component 2516 as a result of current 2524. Concentric magnetic field loops 2534 form around electrical excitation component 2518 as a result of current 2526. Concentric magnetic field loops 2536 form around electrical excitation component 2520 as a result of current 2528. Here, the dots of the concentric magnetic loops represent the magnetic field lines coming out of the paper, whereas the circles of the loops represent the magnetic field lines going into the paper.

Concentric magnetic field loops 2530, 2532, 2534 and 2536 couple into core component 2502, forming magnetic field loop 2538 would have a clockwise polarity as represented by arrow 2540.

Figure 26:
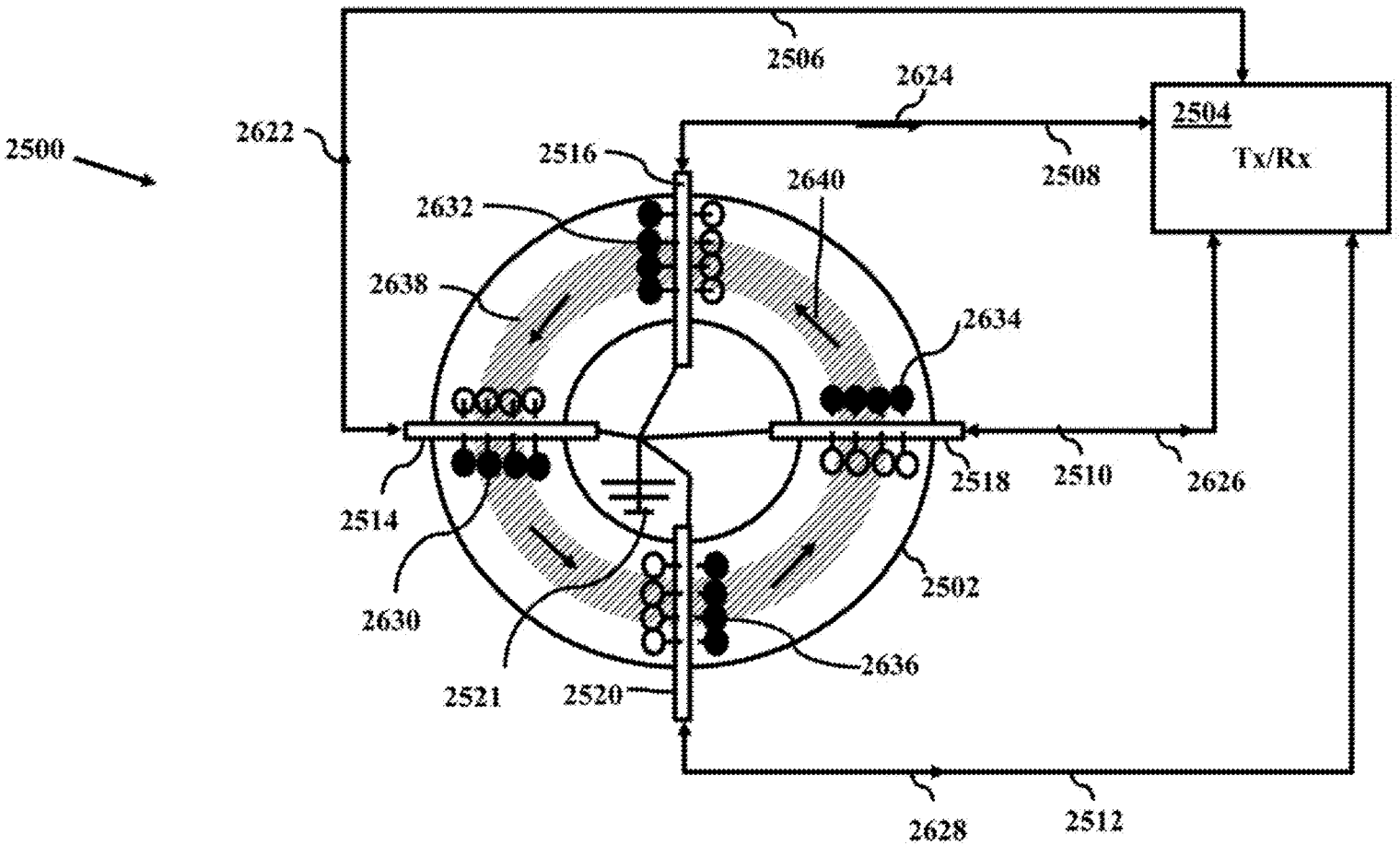
FIG. 26 illustrates a schematic view of the example magnetic loop antenna communication system of FIG. 25, wherein a magnetic loop is traveling in a counter-clockwise direction.

FIG. 26 illustrates a schematic view of example magnetic loop antenna communication system 2500, wherein a magnetic loop is traveling in a counter-clockwise direction.

Transmitter/receiver 2504 is arranged such that, in the transmission mode: a current 2622 is provided through current line 2506 to electrical excitation component 2514 and to ground 2521; a current 2624 is provided through current line 2508 to electrical excitation component 2516 and to ground 2521; a current 2626 is provided through current line 2510 to electrical excitation component 2518 and to ground 2521; and a current 2628 is provided through current line 2512 to electrical excitation component 2520 and to ground 2521.

Concentric magnetic field loops 2630 form around electrical excitation component 2514 as a result of current 2622. Concentric magnetic field loops 2632 form around electrical excitation component 2516 as a result of current 2624. Concentric magnetic field loops 2634 form around electrical excitation component 2518 as a result of current 2626. Concentric magnetic field loops 2636 form around electrical excitation component 2520 as a result of current 2628. Here, the dots of the concentric magnetic loops represent the magnetic field lines coming out of the paper, whereas the circles of the loops represent the magnetic field lines going into the paper.

Concentric magnetic field loops 2630, 2632, 2634 and 2636 couple into core component 2502, forming magnetic field loop 2638 would have a counter-clockwise polarity as represented by arrow 2640.

The gain of a magnetic loop antenna may be maximized by utilizing anisotropic magnetic materials. Magnetic anisotropy is the directional dependence of a material's magnetic properties. In the absence of an applied magnetic field, a magnetically isotropic material has no preferential direction for its magnetic moment, while a magnetically anisotropic material will align its moment with one of the easy axes. An easy axis is an energetically favorable direction of spontaneous magnetization that is determined by the known sources of magnetic anisotropy. The two opposite directions along an easy axis are usually equivalent, and the actual direction of magnetization can be along either of them.

A magnetic material with triaxial anisotropy still has a single easy axis, but it also has a hard axis (direction of maximum energy) and an intermediate axis (direction associated with a saddle point in the energy). An example embodiment exploits the hard axis of a triaxially anisotropic material. This will be described with reference to FIG. 27.

Figure 27:
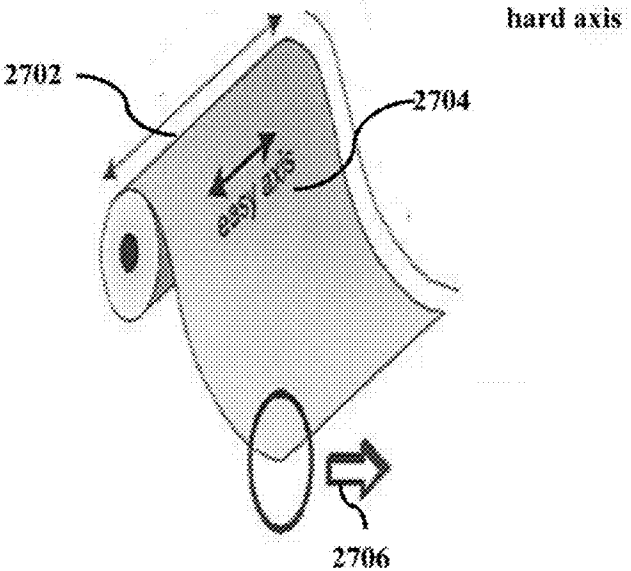
FIG. 27 illustrates another example roll of magnetic film to be cut to form a core component in accordance with aspects of the present invention.

FIG. 27 illustrates another example roll 2702 of an anisotropic magnetic film to be cut to form a core component in accordance with aspects of the present invention.

As shown in the figure, the anisotropic magnetic film of roll 2702 has an easy axis along the direction indicated by double arrow 2704 and a hard axis in the direction indicated by arrow 2706.

The first step in using magnetic film materials is to identify their axes of anisotropy. In this example, a magnetic film is sputtered so as to exhibit a hard axis that is parallel to the direction of roll processing. Once the anisotropy axes have been identified, roll 2702 is cut in a manner similar to that discussed above with reference to FIG. 18. However, in this instance roll 2702 is cut parallel to the hard axis.

Roll 2702 is then cut into widths equal to the vertical height desired for a predetermined magnetic loop antenna. In an example embodiment, a roll is cut into strips that are 0.25" wide to make a 0.25" high magnetic loop antenna.

By taking advantage of the hard axes, a magnetic loop core component in accordance with aspects of the present invention is able to couple a much larger amount of the magnetic field lines from an electrical excitation component.

A magnetic loop antenna in accordance with aspects of the present invention may provide a similar transmission function to that of the conventional electric monopole antenna. This will be described in greater detail with reference to FIGS. 28-29.

Figure 28:
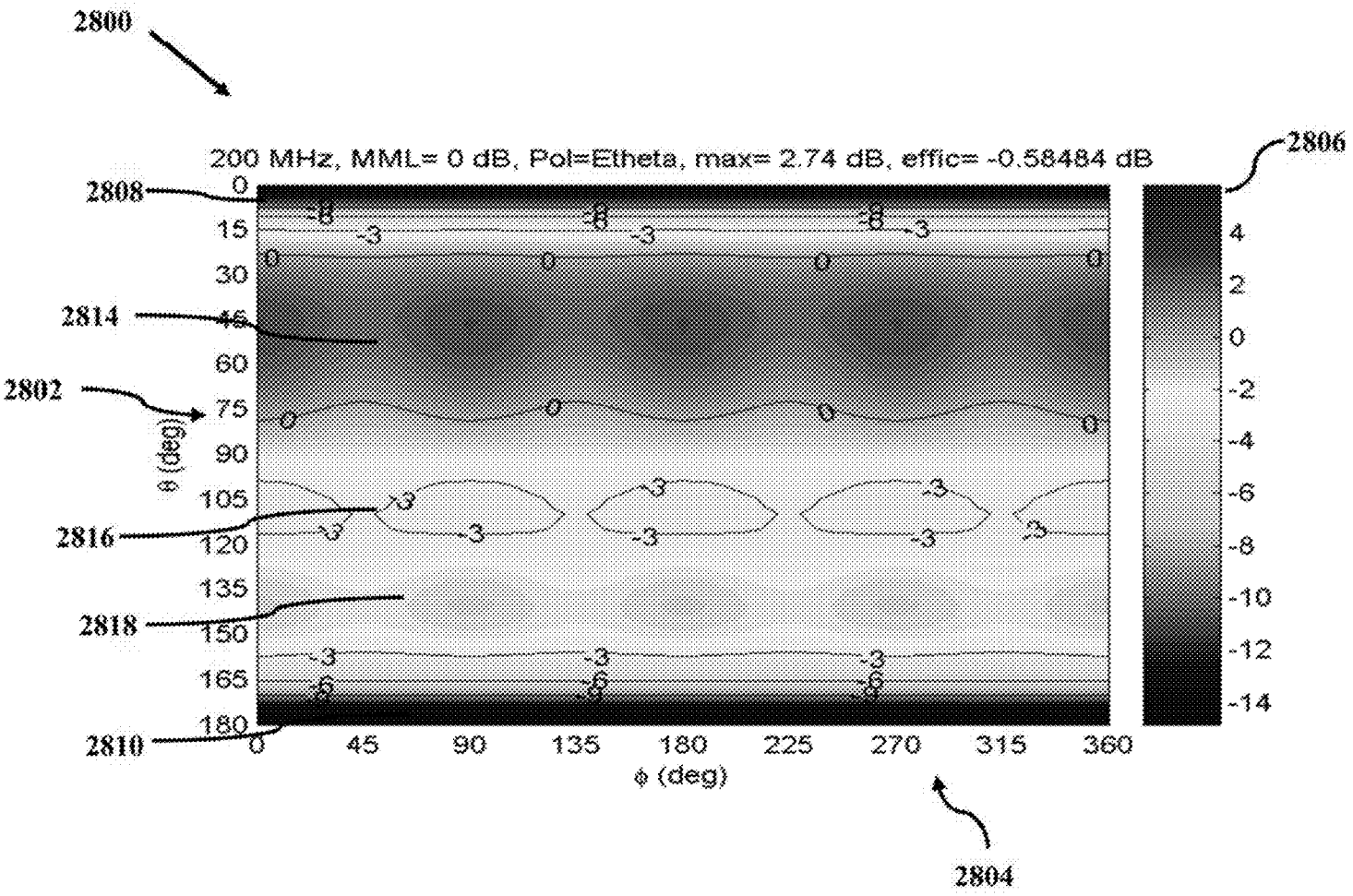
FIG. 28 is a graph illustrating gain as a function of two angles for an example conventional monopole antenna.

FIG. 28 is a graph 2800 illustrating gain as a function of two angles for an example conventional monopole antenna.

As shown in the figure, graph 2800 includes a y-axis 2802 measuring an angle in degrees, and an x-axis 2804 measuring an angle in degrees and scale 2806 measuring gain in dB.

Scale 2806 indicates that gain for graph 2800 ranges from about −14 dB to about 6 dB. An area 2814 of graph 2800 around 45° has the largest gain, at about 3 dB. Area 2814 is bounded by a sudden drop to approximately a 0 gain at approximately 30° and 75°. The lowest gains are registered at 0° and 180°. A lobeing effect is shown at 2816 and 2818, as a result of signal dispersion from a square mounting plane.

Figure 29:
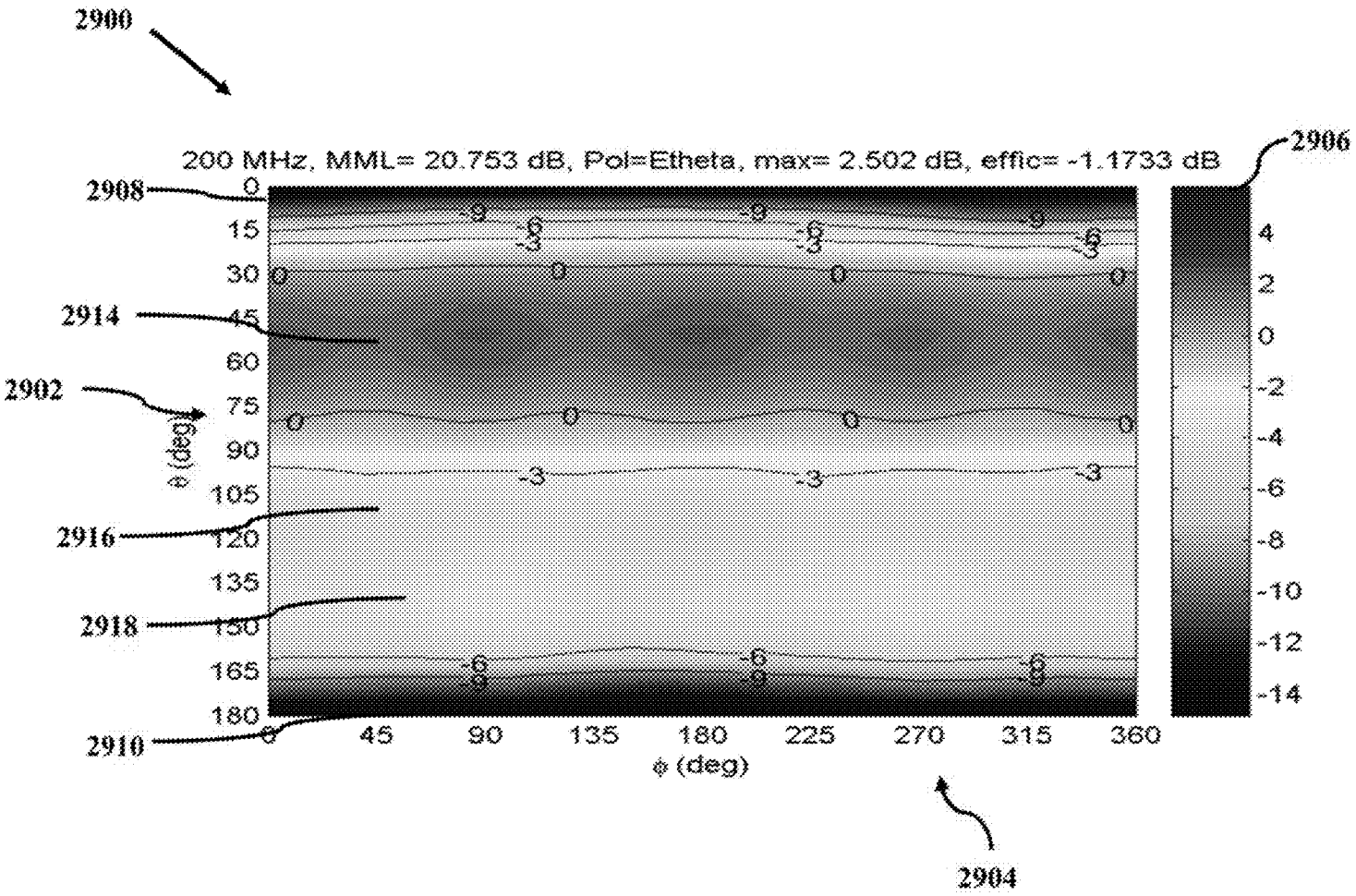
FIG. 29 illustrates is a graph illustrating gain as a function of two angles for an example magnetic loop antenna in accordance with aspects of the present invention.

FIG. 29 illustrates is a graph 2900 illustrating gain as a function of two angles for an example magnetic loop antenna in accordance with aspects of the present invention.

As shown in the figure, graph 2900 includes a y-axis 2902 measuring an angle in degrees, and an x-axis 2904 measuring an angle in degrees and scale 2906 measuring gain in dB.

The similarities between graph 2800 of FIG. 28 and graph 2900 of FIG. 29 highlight the similar transmission functions of a conventional dipole antenna and a magnetic loop antenna in accordance with aspects of the present invention. Similar to scale 2806 of FIG. 28, scale 2906 indicates that gain for graph 2900 ranges from about −14 dB to about 6 dB. Similar to area 2814 of FIG. 700, an area 2914 of graph 2900 around 45° has the largest gain, at about 3 dB. Similar to area 2814 of FIG. 700, area 2914 is bounded by a sudden drop to approximately a 0 gain at approximately 30° and 75°. Similar to graph 2800, in graph 2900, the lowest gains are registered at 0° and 180°. Graph 2900 has slightly less lobeing effects than graph 2800, as shown at 2916 and 2918.

In accordance with aspects of the present invention, a magnetic core component is made of a wound magnetic film, wherein the magnetic film includes a magnetic material layer and a substrate. In the non-limiting examples discussed above, the magnetic core component has a circular shape. It should be noted that a magnetic core component in accordance with aspects of the present invention may have a non-circular shape, non-limiting examples of which include oval and elliptical. Further, if a mandrel is used to wind a core component in accordance with aspects of the present invention, the mandrel may have any shape that is conducive to winding, non-limiting examples of which include star-shaped and polygonally shaped.

The foregoing description of various preferred embodiments of the invention have been presented for purposes of illustration and description. It is not intended to be exhaustive or to limit the invention to the precise forms disclosed, and obviously many modifications and variations are possible in light of the above teaching. The exemplary embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed as new and desired to be protected by Letters Patent of the United States is:

1. An antenna comprising:

an electrical excitation component having an input, an output and a conducting component, said conducting component being disposed between said input and said output and being operable to conduct current from said input to said output; and a core component comprising a wound magnetic film having a substrate and a magnetic material layer, said core component being operable to have a magnetic current loop induced therein, wherein said electrical excitation component is arranged such that concentric magnetic fields associated with current conducted through said electrical excitation component are additionally associated with a magnetic current loop within said core component.

2. The antenna of claim 1, wherein said substrate has a substrate thickness, wherein said magnetic material layer has a magnetic material layer thickness, and wherein the magnetic material layer thickness is larger than the substrate thickness.

3. The antenna of claim 1, wherein said magnetic film has a magnetic film thickness, a magnetic film width and a magnetic film length, wherein the magnetic film thickness is less than the magnetic film width, and wherein the magnetic film width is less than the magnetic film length.

4. The antenna of claim 3, wherein said magnetic material layer comprises an anisotropic magnetic material having an easy axis and a hard axis, and wherein the hard axis is parallel with the magnetic film length.

5. The antenna of claim 1, wherein said magnetic material layer comprises one of the group consisting of NiZn ferrite, $Co_2Z$ hexaferrite, CoFeSiNoB ferromagnetic metal alloy, CoZrNb ferromagnetic metal alloy, and combinations thereof.

6. A method of making an antenna, said method comprising:

providing a mandrel;

anchoring an end of a magnetic film to the mandrel, the magnetic film having a substrate and a magnetic material layer;

winding the magnetic film around the mandrel so as to create a core component surrounding the mandrel, the core component being operable to have a magnetic current loop induced therein; and arranging an electrical excitation component with the core component such that concentric magnetic fields associated with current conducted through the electrical excitation component are additionally associated with the magnetic current loop within the core component.

7. The method of claim 6, wherein the magnetic film has a substrate that has a substrate thickness, wherein the magnetic material layer has a magnetic material layer thickness, and wherein the magnetic material layer thickness is larger than said substrate thickness.

8. The method of claim 6, wherein the magnetic film has a magnetic film thickness, a magnetic film width and a magnetic film length, wherein the magnetic film thickness is less than the magnetic film width, and wherein the magnetic film width is less than the magnetic film length.

9. The method of claim 8, wherein the magnetic material layer comprises an anisotropic magnetic material having an easy axis and a hard axis, and wherein the hard axis is parallel with the magnetic film length.

10. The method of claim 6, wherein the magnetic material layer comprises one of the group consisting of NiZn ferrite, $Co_2Z$ hexaferrite, CoFeSiNoB ferromagnetic metal alloy, CoZrNb ferromagnetic metal alloy, and combinations thereof.

11. The method of claim 6, further comprising:

unwinding the magnetic film from a roll of magnetic film; and managing the tension of the magnetic film via a tension management device.

12. The method of claim 11, wherein said managing the tension of the magnetic film comprises managing the tension of the magnetic film via a roller operable to rotate about an axis.

13. The method of claim 12, further comprising moving the roller in a direction to adjust the tension of the magnetic film.

14. The antenna of claim 1, further comprising to transmitter operable to provide the current to said electrical excitation component.

15. The antenna of claim 1, further comprising a receiver operable to receive the current from said electrical excitation component.

16. The antenna of claim 1, further comprising:

a second electrical excitation component having a second input, a second output and a second conducting component, wherein said second conducting component is disposed between said second input and said second output and is operable to conduct a second current from said second input to said second output, and wherein said second electrical excitation component is arranged such that second concentric magnetic fields associated with the second current conducted through said second electrical excitation component are additionally associated with the magnetic current loop within said core component.

17. The antenna of claim 16, wherein the second current is different from the current.

18. The antenna of claim 1, wherein said magnetic film has a magnetic film thickness, a magnetic film width and a magnetic film length, wherein the magnetic film thickness is less than the magnetic film width, wherein the magnetic film width is less than the magnetic film length, wherein said magnetic material layer comprises an anisotropic magnetic material having an easy axis and a hard axis, wherein the hard axis is parallel with the magnetic film length, and wherein said magnetic material layer comprises one of the group consisting of NiZn ferrite, $Co_2Z$ hexaferrite, CoFeSiNoR ferromagnetic metal alloy, CoZrNb ferromagnetic metal alloy, and combinations thereof.

19. The antenna of claim 8, further comprising:

a second electrical excitation component having a second input, a second output and a second conducting component, wherein said second conducting component is disposed between said second input and said second output and is operable to conduct a second current from said second input to said second output, and wherein said second electrical excitation component is arranged such that second concentric magnetic fields associated with the second current conducted through said second electrical excitation component are additionally associated with the magnetic current loop within said core component.

20. The antenna of claim 19, wherein the second current is different from the current.

* * * * *